US005234138A

United States Patent [19]

De Laforcade

[11] Patent Number: 5,234,138

[45] Date of Patent: Aug. 10, 1993

[54] SELF-CLOSING DISPENSER FOR A CONTAINER CONTAINING A LIQUID OR PASTY PRODUCT

[75] Inventor: Vincent De Laforcade, Clamart, France

[73] Assignee: L'Oreal, Paris, France

[21] Appl. No.: 847,089

[22] PCT Filed: Aug. 27, 1991

[86] PCT No.: PCT/FR91/00692

§ 371 Date: Apr. 13, 1992

§ 102(e) Date: Apr. 13, 1992

[87] PCT Pub. No.: WO92/04244

PCT Pub. Date: Mar. 19, 1992

[30] Foreign Application Priority Data

Aug. 29, 1990 [FR] France ..... 90 10764

[51] Int. Cl.[5] ..... B65D 5/72

[52] U.S. Cl. ..... 222/490; 222/212

[58] Field of Search ..... 222/490, 491, 494, 212, 222/213, 107; 137/859, 852, 860

[56] References Cited

U.S. PATENT DOCUMENTS

| | | | |
|---|---|---|---|
| 1,935,089 | 11/1933 | Hamilton | 222/490 |
| 2,552,715 | 5/1951 | Gray et al. | 222/490 |
| 2,583,340 | 1/1952 | Olsen | 222/490 |
| 2,591,354 | 4/1952 | Harris | 222/490 X |
| 3,349,972 | 10/1967 | Whiteford | 222/490 X |
| 4,728,006 | 3/1988 | Drobish et al. | 222/494 X |
| 4,991,745 | 2/1991 | Brown | 222/490 X |
| 5,005,737 | 4/1991 | Rohr | 222/490 X |

FOREIGN PATENT DOCUMENTS

| | | |
|---|---|---|
| 027812 | 8/1988 | European Pat. Off. . |
| 955907 | 1/1950 | France . |

*Primary Examiner*—Kevin P. Shaver

*Attorney, Agent, or Firm*—Cushman, Darby & Cushman

[57] ABSTRACT

A self-closing dispenser comprising a container capable of containing a pasty product therein, the container having an outlet end. A dome member is mounted on the outlet end of the container, and the dome member has a slit therein through which the pasty product can escape the dispenser. The slit is defined by at least two edges which are normally spaced apart. A rigid cover is attachable to the outlet end of the container to cover a first portion of the dome member. The cover has an opening through which a second portion of the dome member extends, the second portion of the dome member including the slit. Boss members are disposed between the dome member and an inner surface of the cover, the inner surface being adapted to force the boss members into the dome member when the cover is attached to the outlet end to cause a deformation of the dome member. The deformation of the dome member causes the edges defining the slit to come into sealing contact to prevent the pasty product from escaping through the slit.

12 Claims, 1 Drawing Sheet

SELF-CLOSING DISPENSER FOR A CONTAINER CONTAINING A LIQUID OR PASTY PRODUCT

The invention relates to self-closing dispensers for containers containing a liquid or pasty product. These dispensers are of the type comprising a membrane in the form of a convex dome covering one end of the container and at least one slit provided towards the top of the dome of the membrane. The slit is defined by parallel edges adapted to come into contact with one another to seal the dispenser and to move apart to allow the passage of product therethrough when the product is displaced from the dispenser when pressure is applied to the dispenser by squeezing it.

A dispenser of this kind helps make it possible to use the container with only one hand, as it is not necessary to replace a cap on this container in order to prevent outflow of the product when pressure is no longer applied to the dispenser.

The devices known hitherto ensure the desired sealing in a more or less satisfactory manner as soon as pressure ceases to be exerted on the product. The quality of the seal obtained depends, inter alia, on the tolerance with which the slit is produced. In addition, such a design of the slit generally requires additional operations, e.g. cutting with a single blade, increasing the cost price of the device.

The object of the invention is to provide a self-closing dispenser of the type defined hereinbefore, which ensures sealing as soon as the pressure exerted on the product ceases and which, as a result, prevents air intake into the dispenser while having a simple, economical and reliable design.

According to the invention, a self-closing dispenser for a container containing a liquid or pasty product of the type defined hereinbefore is characterised in that a rigid cover is provided to be fixed to the end of the container equipped with the membrane and to partially cover the dome in a region surround the slit which remains uncovered. Projecting supporting means are provided on at least one of the two surfaces formed by the inner surface of cover and the outer surface, of the membrane, and the inner surface of the cover is adapted to correspond to the outer surface of the membrane. A part from the abovementioned supporting means, the whole assembly is such that once the rigid cover has been placed on the container, the action of the supporting means results in deformation of the dome of the membrane and in the edges of the slit fitting together in a sealed manner.

The slit is preferably molded with the membrane such that the edges of the slit are normally spaced slightly apart. Once the rigid capsule has been placed in position the dome is sufficiently deformed to force the edges of the slit together in a sealed manner.

The supporting means advantageously consist of two bosses each in the form of a spherical segment having its center situated in the median plane perpendicular to the length of the slit. These bosses are symmetrical with respect to the diametral plane containing the large dimension of the slit. The bosses are preferably provided on the membrane and are molded directly with this membrane, the bosses having their convexity directed radially towards the exterior.

The dome formed by the membrane is generally spherical and the inner surface of the rigid capsule is a spherical concave surface having the same radius as the dome, apart from the bosses.

The outlet end of the container advantageously comprises an end-cap provided with an external thread, while the rigid cover comprises a sleeve provided with a complementary internal thread adapted to cooperate with the thread of the end-cap in order to hold the cover, the said cover comprising a coaxial cylindrical skirt situated radially between the dome and the sleeve, in order to abut against a shoulder of the container after screwing of the cover.

In addition to the arrangements described hereinabove, the invention also consists of a number of other arrangements which will be described in more detail hereinafter by way of a non-limiting embodiment described with reference to the accompanying drawings, in which.

Figure 2:
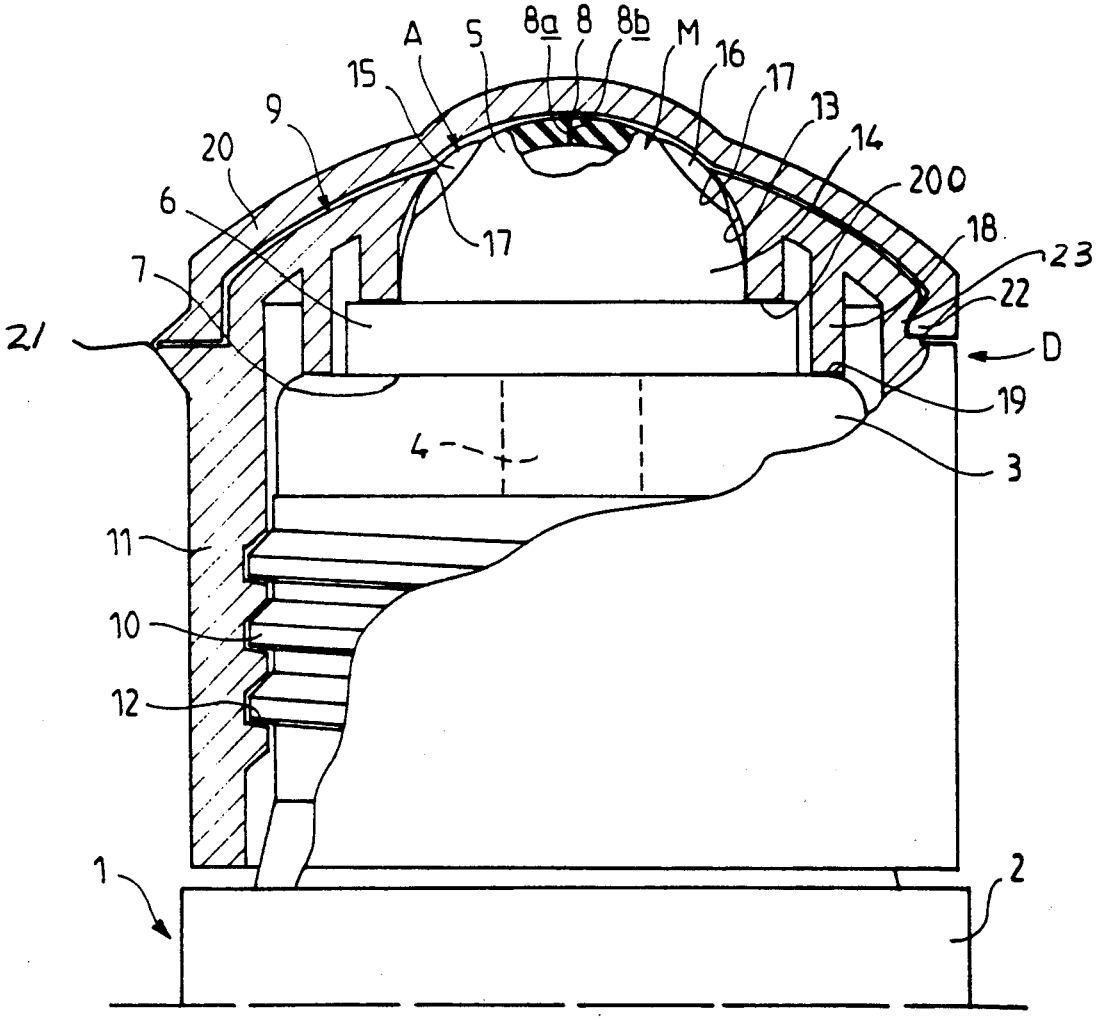
FIG. 2 is an elevation, with some parts in section and some parts broken away, of a dispenser according to the invention, in the closed position of the membrane.

Referring to the drawings, FIG. 2 shows a dispenser D for a container indicated generally at 1. Dispenser D is mounted to tube 2 which contains a pasty product to be dispensed via an outlet end 3 provided with a channel therein.

Delivery of the product is obtained by transmitting pressure to this product. For example the tube 2 can be made with deformable walls, and pressure exerted on the walls of the tube 2 effectuates transmission of the product by displacement through slit 8. According to another possibility, the container 1 or the tube 2 would have rigid walls and the pressure would be transmitted to the product by virtue of the displacement of a piston upwardly through the tube.

The dispenser D comprises a membrane M of elastomeric material, in the form of a convex dome 5 covering the end 3 and the outlet channel 4 of the tube 2. The dome 5 is advantageously formed by a spherical portion and, in the example in question, by a hemisphere. This dome 5 is connected at its equatorial plane to a cylindrical annular 6 having a greater diameter. The inner face 7 of annular portion 6 is adapted to come to rest against the transverse face of the end 3 of the tube.

Figure 1:
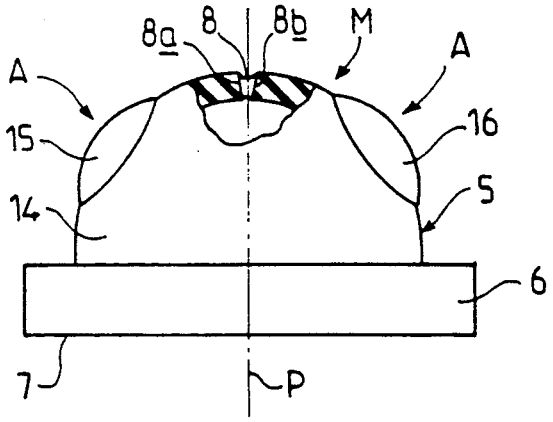
FIG. 1 is an elevation, with broken-away portions, of a membrane for a dispenser according to the invention, and finally.

Rectilinear slit 8, the length of which is perpendicular to the plane of FIGS. 1 and 2, is provided towards the top of the dome 5 to allow for the passage of product. The edges 8*a* and 8*b* of slit 8 are substantially parallel to one another.

A rigid cover 9, generally of plastic is provided to be screwed to the end 3 of the tube. End 3 is designed in the form of an end-cap and has an external thread 10, while the cover 9 has a sleeve 11 provided with a complementary thread 12 to ensure that the cover is held to the end-cap when screwed thereon.

The cover 9 partially covers dome 5 in a region surrounding the slit 8 which remains uncovered.

Projecting bases 15 and 16 are provided on the outer surface 14 of dome 5 and come into contact with the inner surface 13 of cover 9.

Bosses 15 and 16 are each in the shape of a spherical segment. The center of the spherical segment forming each boss 15 and 16 is situated in the median plane perpendicular to the length of the slit 8. The bosses 15 and 16 are symmetrical with respect to this plane.

The inner surface 13 of the capsule 9 geometrically corresponds to the outer surface of dome 5. In other words, the inner surface 13 of the cover is concave, having the same radius as the convex spherical outer surface 14 of the dome.

The two bosses 15 and 16 come into contact with the inner surface 13 over a small almost punctiform zone, preferably situated in the vicinity of the circular edge 17 of the opening formed in the cover 9 for the passage of the upper part of the dome 5. The cover 9 comprises a cylindrical skirt 18 coaxial with the sleeve 11 and situated radially between the dome 5 and this sleeve 11. The transverse lower end face of the skirt 18 is adapted, after screwing of the cover 9, to abut against a shoulder 19 formed by the transverse end face of the end-cap 3.

The base 200 of the concave spherical inner surface 13 of the cover simultaneously comes to rest against the annular portion 6 which may be subjected to deformation. The deformation of the portion 6 is limited by the skirt 18 abutting against the shoulder 19.

The bosses 15 and 16, in particular the projection thereof relative to the spherical surface 14, are defined in such a manner that once the cover 9 has been placed on the end-cap 3 by screwing, the cooperation of the inner surface 13 of the cover and bosses 15 and 16 results in deformation of the dome 5 and in the edges 8*a* and 8*b* fitting together in a sealed manner.

Edges 8*a* and 8*b*, in the normal state of the membrane as illustrated in FIG. 1, may be spaced slightly apart. When slit 8 is in such condition, it may be molded with the membrane thereby considerably simplifying the manufacturing process without affecting sealing after mounting of the cover 9.

The material of membrane M, in the form of a dome 5, is selected to be sufficiently flexible to allow slit 8 to be forced closed by bosses 15 and 16 resting against the surface 13 when cover 9 is in place, and to allow for easy opening of slit 8 when limited pressure is exerted on the tube 2 by the user and transmitted to the product. Test have been conducted on elastomers to determine the optimal Shore hardness of dome 5. Elastomers in excess of 60 A Shore and more particularly approximately 20 A Shore were selected as the best material for dome 5.

The materials in question are preferably of the EPDM family, i.e., copolymers of ethylene and polypropylene which are satined at the time of molding.

It is also possible to utilize several different elastomers, such as natural, nitrile, or butyl rubbers, in so far as they are compatible with the packaged product.

The cover 9 is provided with a cap 20 hinged via film hinge 21 to cover 9 to cover the top portion of cover 9 and dome 5 as shown in FIG. 2. The cap 20 has a shape which rests lightly against the part of the membrane M projecting beyond cover 9. The portion of the cap diametrically opposite the hinge 21 has a hooking catch 22 adapted to snap into a groove 23 of the cover.

In FIG. 2, the cap 20 is shown in the closed position. It ensures additional safety by creating a second sealing barrier. The cap 20, in the closed position, prevents the product from being dispensed even when pressure is applied on the tube.

In use, the cap is opened by pivoting it approximately 180° about the hinge 21.

The cap 20 may be molded in one piece with the cover 9 in the open position.

The mounting and operation of the dispenser will be immediately clear from the preceding description.

The membrane M is placed on the end of the end-cap 3, the face 7 of the portion 6 coming to rest against the end of this end-cap. At this moment, the membrane M is in its normal state and the edges 8*a* and 8*b* of the slit 8 are spaced apart, as illustrated in FIG. 1.

The cover 9 is then placed in position by screwing the sleeve 11 on to the end-cap 3.

Towards the end of the screwing operation, bosses 15 and 16 are pressed inwardly with respect to dome 5 as a result of their contact with the inner surface of cover 9. When bosses 15 and 16 are pressed inwardly, dome 5 is correspondingly deformed on either side of the slit 8 to bring edges 8*a* and 8*b* together. The deforming force is substantially perpendicular to the length of slit and directed from the exterior towards the slit, this resulting in the edges 8*a* and 8*b* fitting together and in closure of the slit.

This results in a dispenser which is normally closed and sealed. This closure is obtained by virtue of an effective positive force, as a result of the cooperation of the bosses 15, 16 and the cover 9. The closure ensured by the membrane M is complemented by that ensured by the cap 20.

In order to dispense the product, the cap 20 is opened by pivoting it about the hinge 21 so as to completely release the outer part of the dome 5 and the cover 9 surrounding it.

When pressure is exerted on the tube 2, this pressure is transmitted to the product which acts on the inner surface of the dome 5 and opens the slit 8, thereby allowing for delivery of this product when the pressure exerted on the tube 2 is sufficient.

As soon as the pressure ceases, slit 8 closes again automatically.

By virtue of the dispenser of the present invention it is possible to prevent any intake of air into the dispenser when dispensing the product.

I claim:

1. A self-closing dispenser comprising:

a container capable of containing a liquid or pasty product therein, said container having an outlet end;

a dome member mounted on said outlet end of said container, said dome member having a slit therein through which the pasty product can escape said dispenser, said slit being defined by at least two edges, said edges normally being spaced apart;

a rigid cover attachable to the outlet end of said container to cover a first portion of said dome member, said cover having an opening through which a second portion of said dome member extends, said second portion of said dome member including said slit; and boss means, disposed between said dome member and an inner surface of said cover, for cooperating with said inner surface so that said boss means is forced by said inner surface against said dome member when said cover is attached to said outlet end to cause a deformation of said dome member, said deformation of said dome member causing said edges defining said slit to come into sealing contact to prevent said pasty product from escaping through said slit.

2. The dispenser as claimed in claim 1 wherein said edges are moved apart and said pasty product is dispensed when pressure is applied to the pasty product by compression of said container.

3. The dispenser as claimed in claim 1 wherein said edges are substantially parallel when the edges of said slit are in sealing contact, and said boss means being two semi-spherical shaped portions.

4. The dispenser as claimed in claim 3 wherein a first of the two semi-spherical shaped portions is disposed on one side of the length of the slit and a second of the two semi-spherical shaped portions is disposed on the other side of the slit.

5. The dispenser as claimed in claim 1 wherein the boss means are molded integrally with said dome member.

6. The dispenser as claimed in claim 1 wherein the dome member is generally semi-spherical in shape and the inner surface of said cover has a substantially concave surface with a substantially similar radius as the dome member.

7. The dispenser as claimed in claim 1 wherein the dome member is made of an elastomer having a Shore hardness greater than 60 A Shore.

8. The dispenser as claimed in claim 1 wherein the dome member is made of an elastomer having a Shore hardness of about 20 A Shore.

9. The dispenser as claimed in claim 1 wherein the dome is made of a ethylene propylene diene monomer material.

10. The dispenser as claimed in claim 1 wherein the outlet end of the container comprises an end portion having an external thread and said rigid cover has a sleeve with an internal thread adapted to cooperate with said external thread to attach said cover to said outlet end.

11. The dispenser as claimed in claim 1 wherein a cap is hinged to said cover for covering the second portion and said slit of said dome member when the dispenser is not in use.

12. The dispenser as claimed in claim 11 wherein said cap is hinged to said cover by means of a film hinge.

* * * * *